US010475562B2

(12) United States Patent
Miyata et al.

(10) Patent No.: US 10,475,562 B2
(45) Date of Patent: Nov. 12, 2019

(54) METHOD FOR MAINTAINING REFRIGERATION UNIT AND REFRIGERATION UNIT

(71) Applicant: JAPAN SUPERCONDUCTOR TECHNOLOGY INC., Kobe-shi (JP)

(72) Inventors: Hitoshi Miyata, Kobe (JP); Atsuko Oka, Kobe (JP)

(73) Assignee: JAPAN SUPERCONDUCTOR TECHNOLOGY INC., Kobe-shi (JP)

( * ) Notice: Subject to any disclaimer, the term of this patent is extended or adjusted under 35 U.S.C. 154(b) by 123 days.

(21) Appl. No.: 15/466,967

(22) Filed: Mar. 23, 2017

(65) Prior Publication Data

US 2017/0287606 A1 Oct. 5, 2017

(30) Foreign Application Priority Data

Mar. 30, 2016 (JP) ..... 2016-068758

(51) Int. Cl.

| | |
|---|---|
| ***F25D 3/10*** | (2006.01) |
| ***H01F 6/04*** | (2006.01) |
| ***F25D 19/00*** | (2006.01) |
| *F25B 9/10* | (2006.01) |

(52) U.S. Cl.

CPC ..... *H01F 6/04* (2013.01); *F25D 19/006* (2013.01); *F25B 9/10* (2013.01)

(58) Field of Classification Search

CPC ..... H01F 6/04; F25D 19/006; B23P 15/26; F25B 9/10; F04B 37/08; F04B 37/085; F04F 9/00

See application file for complete search history.

(56) References Cited

U.S. PATENT DOCUMENTS

| | | | | |
|---|---|---|---|---|
| 5,379,600 | A * | 1/1995 | Moritsu | F17C 3/085 505/892 |
| 5,647,218 | A * | 7/1997 | Kuriyama | F25B 9/14 62/175 |
| 2005/0166600 | A1* | 8/2005 | Mitsubori | F25B 9/14 62/6 |
| 2007/0214802 | A1 | 9/2007 | Nemoto et al. | |
| 2010/0113282 | A1* | 5/2010 | Kawashima | F25D 19/006 505/163 |
| 2010/0201379 | A1* | 8/2010 | Retz | H01F 6/04 324/636 |

FOREIGN PATENT DOCUMENTS

| | | |
|---|---|---|
| JP | H02-004172 A | 1/1990 |
| JP | 2002-252380 A | 9/2002 |
| JP | 2007-194258 | 8/2007 |

OTHER PUBLICATIONS

Japanese Office Action dated May 28, 2019 in Japanese Patent Application No. 2016-068758 w/English translation.

* cited by examiner

*Primary Examiner* — Keith M Raymond
*Assistant Examiner* — Webeshet Mengesha
(74) *Attorney, Agent, or Firm* — Oblon, McClelland, Maier & Neustadt, L.L.P.

(57) ABSTRACT

A method for maintaining a refrigeration unit includes a connecting step of connecting a refrigerator body to a vacuum case with a first cooling stage in thermal contact with a radiation shield, where in the connecting step, the fastening force of the fastening member is adjusted such that the temperature of the first cooling stage becomes a target temperature.

5 Claims, 6 Drawing Sheets

METHOD FOR MAINTAINING REFRIGERATION UNIT AND REFRIGERATION UNIT

TECHNICAL FIELD

The present invention relates to a refrigeration unit used for a superconducting magnet device.

BACKGROUND ART

A superconducting magnet device that generates a high magnetic field using a superconducting coil in a superconducting state has conventionally been known. For example, JP 2007-194258 A discloses a superconducting magnet device including a superconducting coil, a cryogenic container containing the superconducting coil and liquid helium, a heat shield housing the cryogenic container, a vacuum case housing the heat shield, and a refrigerator, mounted on the vacuum case, for refrigerating the heat shield and the superconducting coil. The refrigerator includes a first cooling stage for cooling the heat shield via a heat transfer member, a second cooling stage for cooling the superconducting coil with helium, and a refrigerator body fixed to the vacuum case with the first cooling stage in thermal contact with the heat shield via the heat transfer member. In many cases, the refrigerator body is fixed to the vacuum case by fastening members such as bolts.

To maintain the refrigerator of the superconducting magnet device, the fastening members are removed and the refrigerator is pulled out of (removed from) the vacuum case.

For the superconducting magnet device as disclosed in JP 2007-194258 A, it is difficult to remount the refrigerator on the vacuum case with the first cooling stage in suitable thermal contact with a radiation shield after maintenance or replacement of the refrigeration unit. Specifically, the first cooling stage in contact with the radiation shield at a high contact pressure creates a preferable thermal contact between the first cooling stage and the radiation shield. However, an excessive fastening force applied by the fastening member might damage the first cooling stage. In contrast, an insufficient fastening force applied by the fastening member results in insufficient thermal contact between the first cooling stage and the radiation shield, which leads to failure of sufficiently cooling the radiation shield. The fastening member thus needs to be fastened such that a fastening force applied by the fastening member is not too large but not too small. It is however difficult to fasten the fastening member so as to produce a fastening force within such a preferable range.

The aforementioned problem may also arise in a device that does not include liquid helium and a helium tank storing the liquid helium, that is, a superconducting magnet device that cools a superconducting coil not by liquid helium but by a second cooling stage via a member, such as a plate having high thermal conductivity.

SUMMARY OF INVENTION

An object of the present invention is to provide a method for maintaining a refrigeration unit and a refrigeration unit that allow a refrigerator body to be mounted on a vacuum case with a first cooling stage in a suitable thermal contact with a radiation shield.

A method for maintaining a refrigeration unit according to one aspect of the present invention is used for a superconducting magnet device including a superconducting coil, a radiation shield housing the superconducting coil, and a vacuum case housing the radiation shield, the refrigeration unit including a first cooling stage for cooing the radiation shield, a second cooling stage for cooling the superconducting coil, and a refrigerator body attachable to the vacuum case, the method including a connecting step of connecting the refrigerator body to the vacuum case with the first cooling stage in thermal contact with the radiation shield, wherein, in the connecting step, a fastening force of a fastening member is adjusted such that a temperature of the first cooling stage becomes a target temperature, the fastening member being for fixing the refrigerator body to the vacuum case and being configured to adjust, through adjustment of the fastening force of the fastening member, a contact pressure of the first cooling stage to the radiation shield or a heat conduction member in thermal contact with the radiation shield.

A refrigeration unit according to one aspect of the present invention is used for a superconducting magnet device including a superconducting coil, a radiation shield housing the superconducting coil, and a vacuum case housing the radiation shield, the refrigeration unit including: a refrigerator including a first cooling stage for cooing the radiation shield, a second cooling stage for cooling the superconducting coil, and a refrigerator body attachable to the vacuum case with the first cooling stage in thermal contact with the radiation shield; a temperature sensor connected to the first cooling stage; a fastening member configured to detachably connect the refrigerator body to the vacuum case and to adjust, through adjustment of a fastening force of the fastening member, a contact pressure of the first cooling stage to the radiation shield or a heat conduction member in thermal contact with the radiation shield; and a stroke adjusting member that is provided between the fastening member and the vacuum case, configured to produce a fastening resistance against fastening of the fastening member by contact with the fastening member, and to elastically deform by compression such that a distance between the fastening member and the vacuum case gradually decreases as the fastening force of the fastening member increases against the fastening resistance.

DESCRIPTION OF EMBODIMENTS

A superconducting magnet device according to an embodiment of the present invention will now be described with reference to FIGS. 1 to 6.

Figure 1:
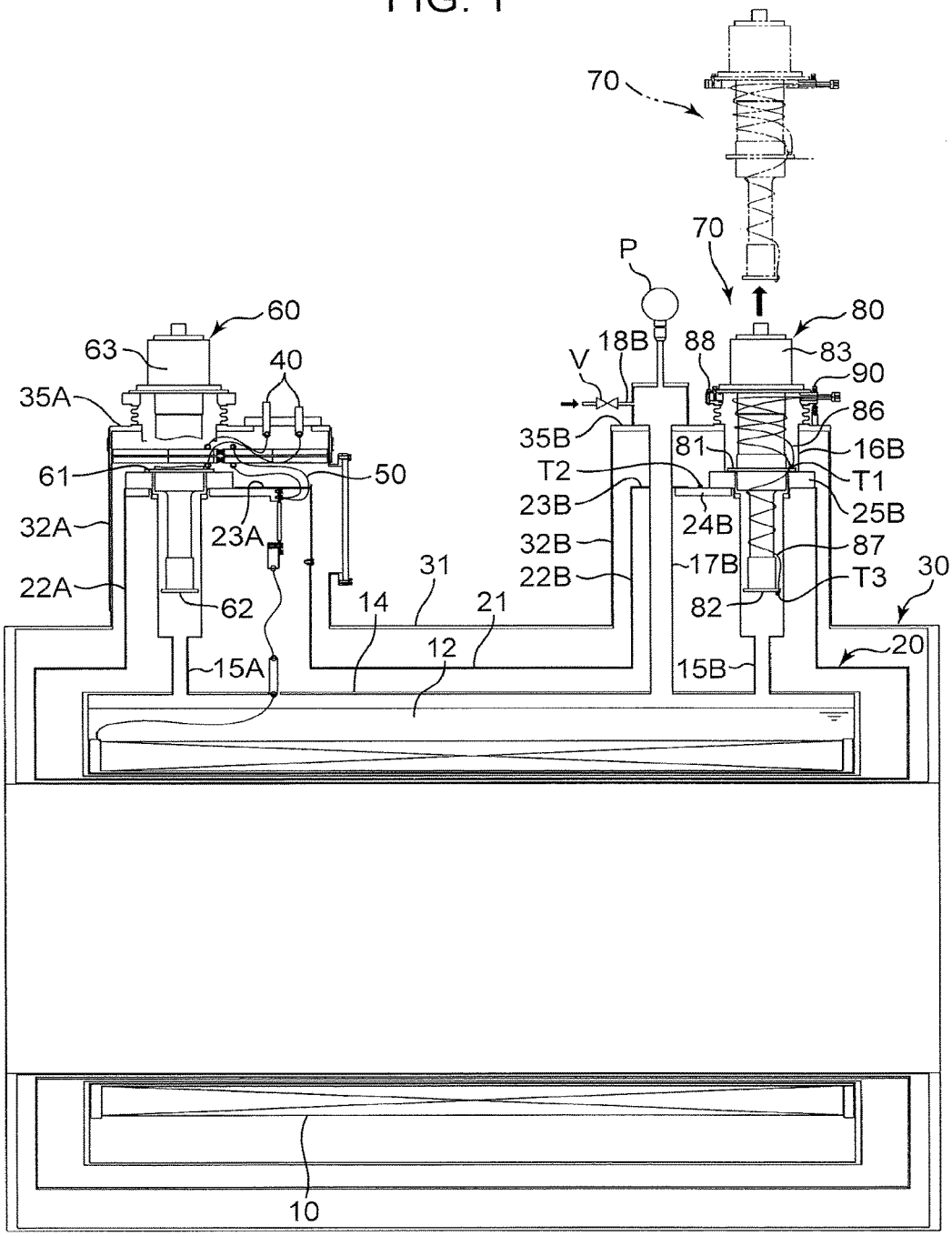
FIG. 1 is a sectional view schematically illustrating a superconducting magnet device according to an embodiment of the present invention.

As illustrated in FIG. 1, the superconducting magnet device includes a superconducting coil 10, a helium tank 14, a radiation shield 20, a vacuum case 30, an electrode member 40, a conductive member 50, a first refrigerator 60, and a refrigeration unit 70 including a second refrigerator 80.

The superconducting coil 10 is formed by winding a wire made of a superconductor (superconducting material) around a frame.

The helium tank 14 houses the superconducting coil 10 and stores liquid helium 12. The helium tank 14 is made of stainless steel. As illustrated in FIG. 1, the helium tank 14 houses the superconducting coil 10 with the central axis of the superconducting coil 10 kept horizontal. A first inner sleeve 15A encircling a portion of the first refrigerator 60 and a second inner sleeve 15B encircling a portion of the refrigeration unit 70 are joined to the helium tank 14. The inner sleeves 15A and 15B are joined to the upper portion of the helium tank 14 with the central axes of the inner sleeves 15A and 15B perpendicular to the axial direction of the helium tank 14. The second inner sleeve 15B is located remote from the first inner sleeve 15A in the axial direction of the helium tank 14. Helium gas vaporized from the liquid helium 12 in the helium tank 14 is cooled by the refrigerators 60 and 80 respectively inside the inner sleeves 15A and 15B and condenses. The condensed liquid helium 12 drops into the helium tank 14.

The radiation shield 20 has a shape that covers the helium tank 14 and the inner sleeves 15A and 15B. The radiation shield 20 is made of aluminum. The radiation shield 20 minimizes heat transfer into the helium tank 14 from the outside of the radiation shield 20. The radiation shield 20 includes an inner body 21 housing the helium tank 14, a first inner surrounding cover 22A, and a second inner surrounding cover 22B.

The first inner surrounding cover 22A is joined to the inner body 21 and has a shape surrounding the first inner sleeve 15A. The first inner surrounding cover 22A is joined to the upper portion of the inner body 21 with the axial direction of the first inner surrounding cover 22A perpendicular to the axial direction of the inner body 21. A first inner top wall 23A is joined to the top end of the first inner surrounding cover 22A.

The second inner surrounding cover 22B is joined to the inner body 21 and has a shape surrounding the second inner sleeve 15B. The second inner surrounding cover 22B is joined to the upper portion of the inner body 21 with the axial direction of the second inner surrounding cover 22B perpendicular to the axial direction of the inner body 21. A second inner top wall 23B is joined to the top end of the second inner surrounding cover 22B. In the embodiment, a cooling plate 24B made of a material having a high thermal conductivity (such as copper) is connected to the second inner top wall 23B. A temperature sensor T2 is attached to the top face of the cooling plate 24B. A flange 25B is connected to the top face of the cooling plate 24B. The flange 25B is connected to the top end of the second inner sleeve 15B and is made of a material having a high thermal conductivity (such as copper).

The vacuum case 30 has a shape that covers the radiation shield 20. The inside of the vacuum case 30 is kept in a vacuum condition. This minimizes heat transfer into the vacuum case 30. The vacuum case 30 includes an outer body 31, a first outer surrounding cover 32A, and a second outer surrounding cover 32B.

The outer body 31 houses the helium tank 14 and the inner body 21. Specifically, the outer body 31 includes an inner circumferential wall and an outer circumferential wall each having a cylindrical shape. The superconducting coil 10, the helium tank 14, and the inner body 21 are housed in a space between the inner circumferential wall and the outer circumferential wall. The outer body 31 is made of stainless steel.

The first outer surrounding cover 32A is joined to the outer body 31 and has a shape surrounding the first inner surrounding cover 22A. The first outer surrounding cover 32A of the embodiment has a cylindrical shape. A first outer top wall 35A is joined to the top end of the first outer surrounding cover 32A, and the electrode member 40 and the first refrigerator 60 are connected to the first outer top wall 35A. The electrode member 40 is connected to the superconducting coil 10 via the conductive member 50.

The second outer surrounding cover 32B is joined to the outer body 31 and has a shape surrounding the second inner surrounding cover 22B. The second outer surrounding cover 32B of the embodiment has a cylindrical shape. A second outer top wall 35B is joined to the top end of the second outer surrounding cover 32B, and a helium gas passage 17B and the refrigeration unit 70 are connected to the second outer top wall 35B. A second outer sleeve 16B surrounding a portion of the refrigeration unit 70 is provided between the second outer top wall 35B and the flange 25B.

The first refrigerator 60 can detachably be connected to the first outer top wall 35A of the vacuum case 30. The first refrigerator 60 includes a first cooling stage 61, a second cooling stage 62, and a refrigerator body 63 connected to the first outer top wall 35A.

The first cooling stage 61 is thermally connected to the first inner top wall 23A of the radiation shield 20. The second cooling stage 62 is disposed inside the first inner sleeve 15A extending upward from the helium tank 14. When the refrigerator body 63 is driven, the temperature of the first cooling stage 61 becomes 30 K to 60 K and the temperature of the second cooling stage 62 becomes about 4 K. In the embodiment, when the refrigerator body 63 is driven, the radiation shield 20 is cooled to a temperature of about 40 K to 90 K and the helium gas evaporated from the liquid helium 12 in the helium tank 14 condenses by being cooled by the second cooling stage 62.

Figure 2:
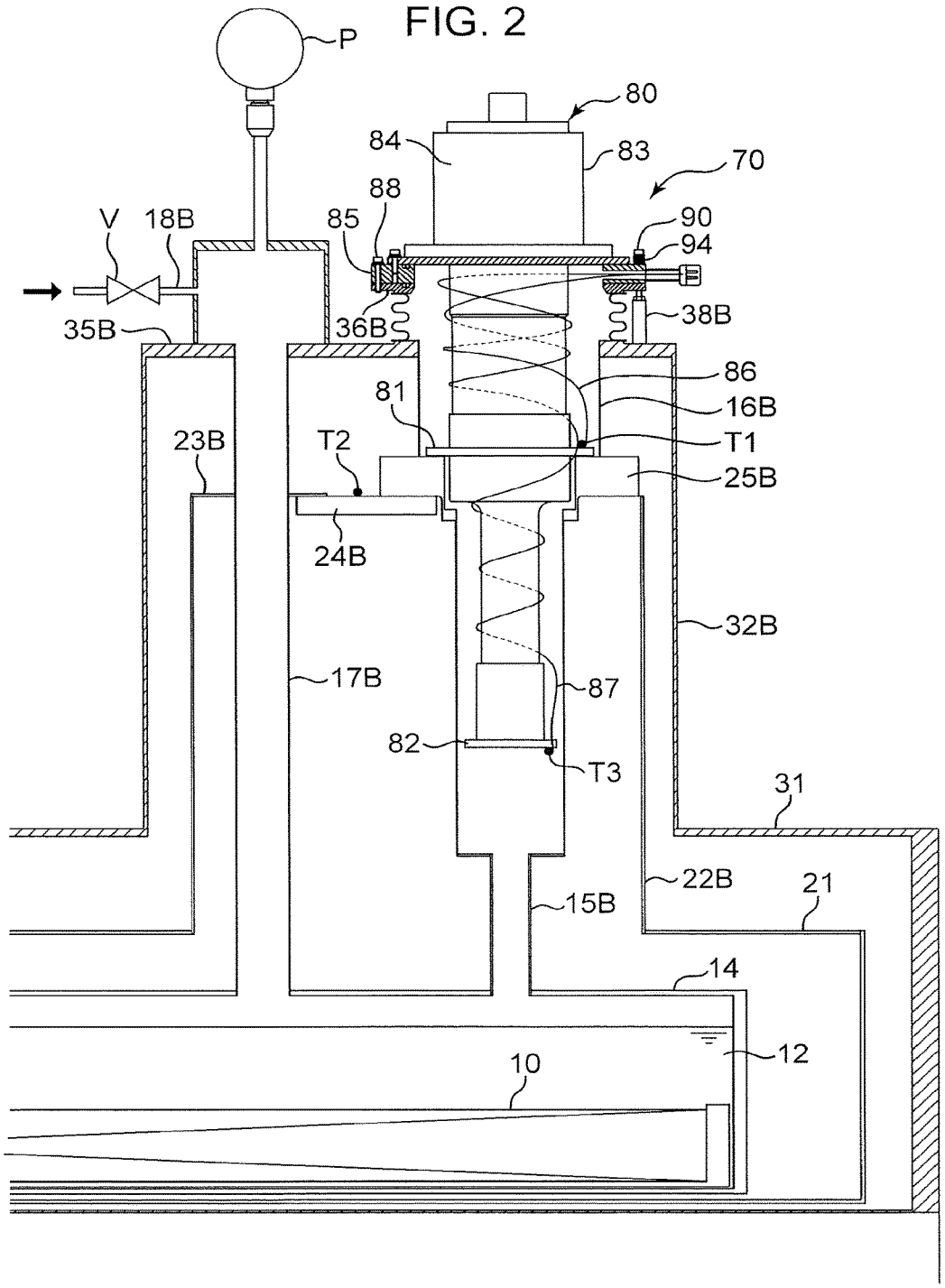
FIG. 2 is an enlarged view illustrating a region around a refrigeration unit including a sectional view taken along line II-II in FIG. 5.

As illustrated in FIGS. 1 and 2, the helium gas passage 17B extends from the upper portion of the helium tank 14 to the second outer top wall 35B. A helium gas supply line 18B is coupled to the upper portion of the helium gas passage 17B to supply helium gas into the helium tank 14 through the helium gas passage 17B. The helium gas supply line 18B is provided with a check valve V. The check valve V permits the helium gas to flow to the outside of the vacuum case 30 through the helium gas passage 17B while inhibiting the air from flowing from outside the vacuum case 30 into the helium gas passage 17B. Thus, if a larger amount of the liquid helium 12 in the helium tank 14 evaporates to raise the pressure in the helium tank 14 above a standard value, the helium gas flows out of the vacuum case 30 through the check valve V. A differential pressure gauge P is provided on the upper portion of the helium gas passage 17B. The differential pressure gauge P calculates the difference between the pressure in the helium tank 14 and the pressure outside the vacuum case 30.

The refrigeration unit 70 can detachably be connected to the second outer top wall 35B of the vacuum case 30. The refrigeration unit 70 includes the second refrigerator 80. The second refrigerator 80 is configured almost the same as the first refrigerator 60. That is, the second refrigerator 80 includes a first cooling stage 81, a second cooling stage 82, and a refrigerator body 83 connected to the second outer top wall 35B.

As illustrated in FIG. 2, the first cooling stage 81 is connected to the flange 25B connected to the top end of the second inner sleeve 15B. The bottom face of the first cooling stage 81 and the top face of the flange 25B are each flat. In the embodiment, the first cooling stage 81 is thermally connected to the radiation shield 20 via the flange 25B and the cooling plate 24B. That is, in the embodiment, the flange 25B and the cooling plate 24B constitute a "heat conduction member".

Figure 3:
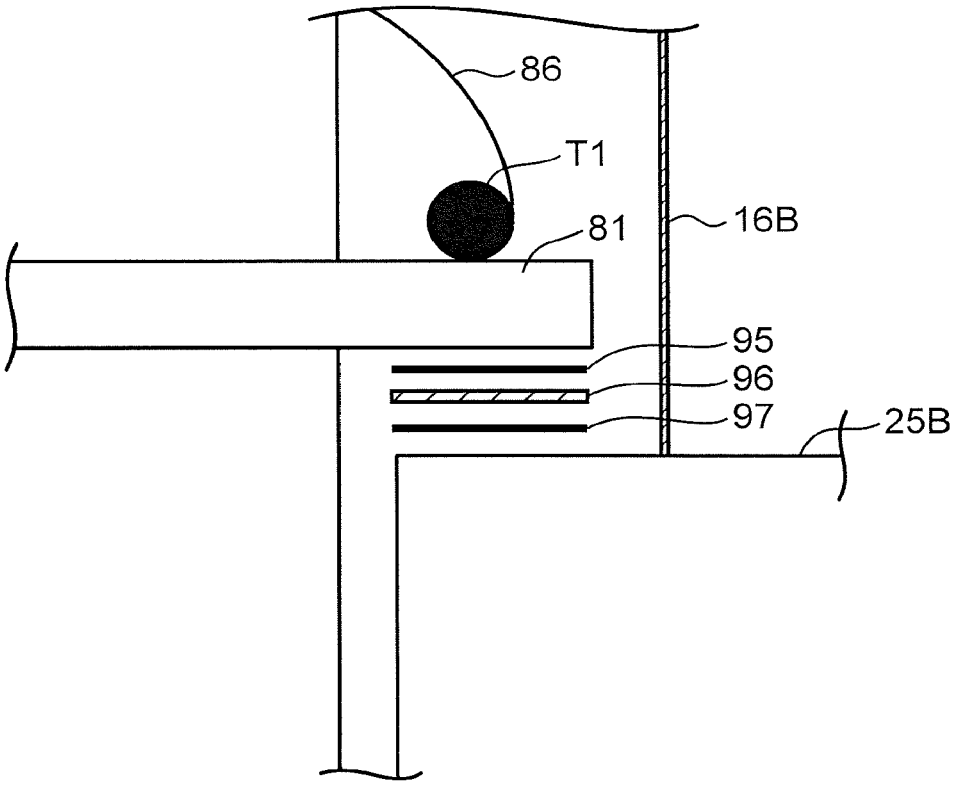
FIG. 3 illustrates a heat conduction sheet and a heat conduction separative layer.

As illustrated in FIG. 3, a heat conduction grease 95, a heat conduction sheet 96, and a heat conduction separative layer 97 are provided between the first cooling stage 81 and the flange 25B. The heat conduction sheet 96 is for filling the gap between the first cooling stage 81 and the flange 25B and may be, for example, an indium sheet. The heat conduction separative layer 97 allows the first cooling stage 81 to separate easily from the flange 25B and may be made of, for example, molybdenum disulfide powder.

The second cooling stage 82 is disposed inside the second inner sleeve 15B and causes helium gas inside the second inner sleeve 15B to condense.

The refrigerator body 83 can detachably be connected to the vacuum case 30 with the first cooling stage 81 in thermal contact with the radiation shield 20. The refrigerator body 83 includes a driving unit 84 and the protruding portion 85 connected to the bottom face of the driving unit 84 and protruding outward in the radial direction of the driving unit 84. The protruding portion 85 has a ring shape.

Besides the second refrigerator 80, the refrigeration unit 70 according to the embodiment includes a temperature sensor T1, a plurality of fixing members 88, a plurality of fastening members 90, and a stroke adjusting member 94.

The temperature sensor T1 is attached to the top face of the first cooling stage 81. The temperature sensor T1 detects the temperature of the first cooling stage 81. A wire 86 connected to the temperature sensor T1 is provided on the protruding portion 85 and is led outside the protruding portion 85 through a wiring hole 85*a* (see FIG. 4) provided in the protruding portion 85 and configured to permit insertion of the wire 86. In the embodiment, a temperature sensor T3 is attached to the second cooling stage 82, and a wire 87 connected to the temperature sensor T3 is also led outside the protruding portion 85 through the wiring hole 85*a*.

The plurality of fixing members 88 and the plurality of fastening members 90 are for fixing the refrigerator body 83 to the vacuum case 30 with the first cooling stage 81 in thermal contact with the radiation shield 20 (in the embodiment, the first cooling stage 81 is in contact with the flange 25B). Note that, the fixing members 88 are omitted in FIG. 4.

Figure 4:
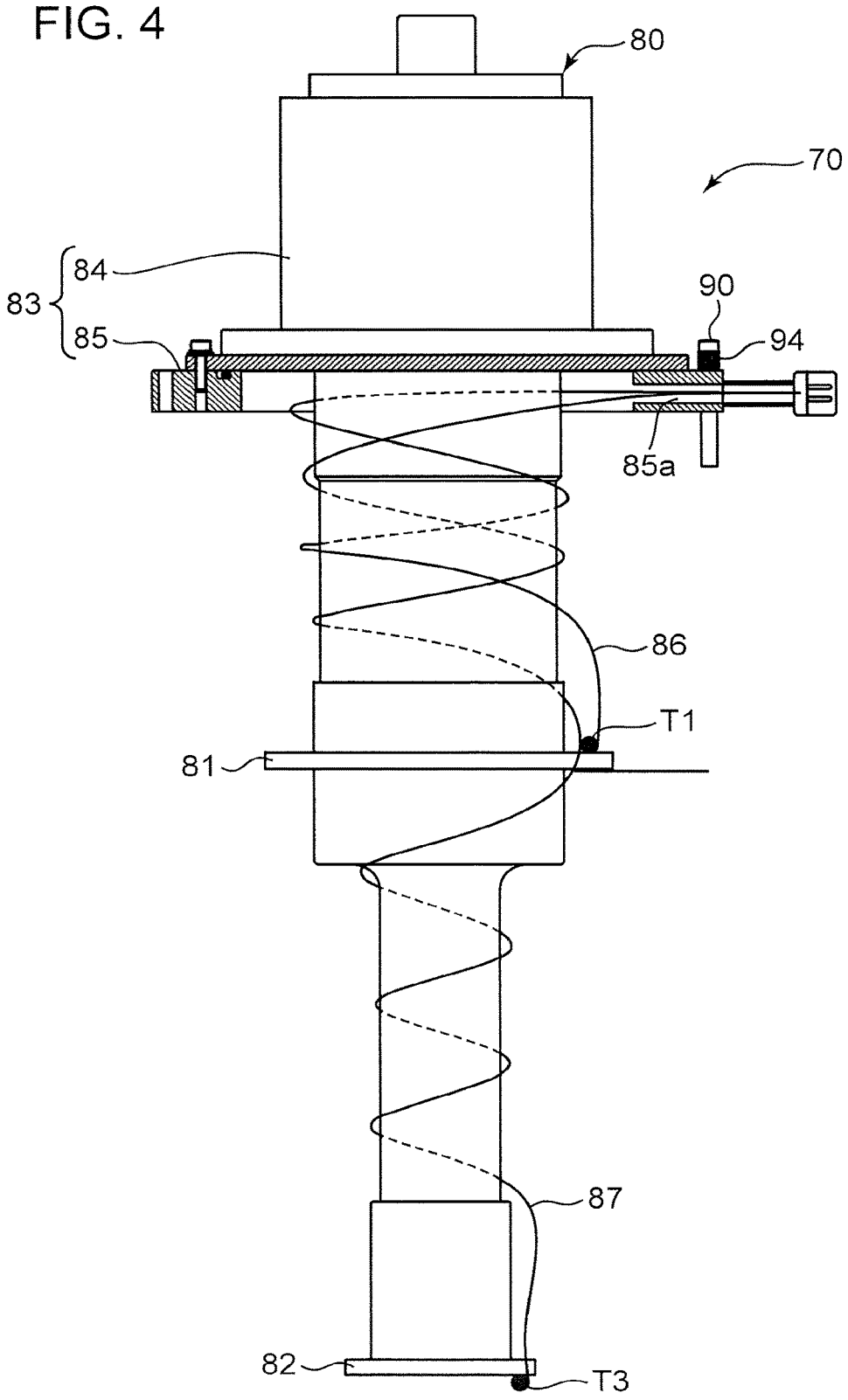
FIG. 4 schematically illustrates a refrigeration unit.
Figure 5:
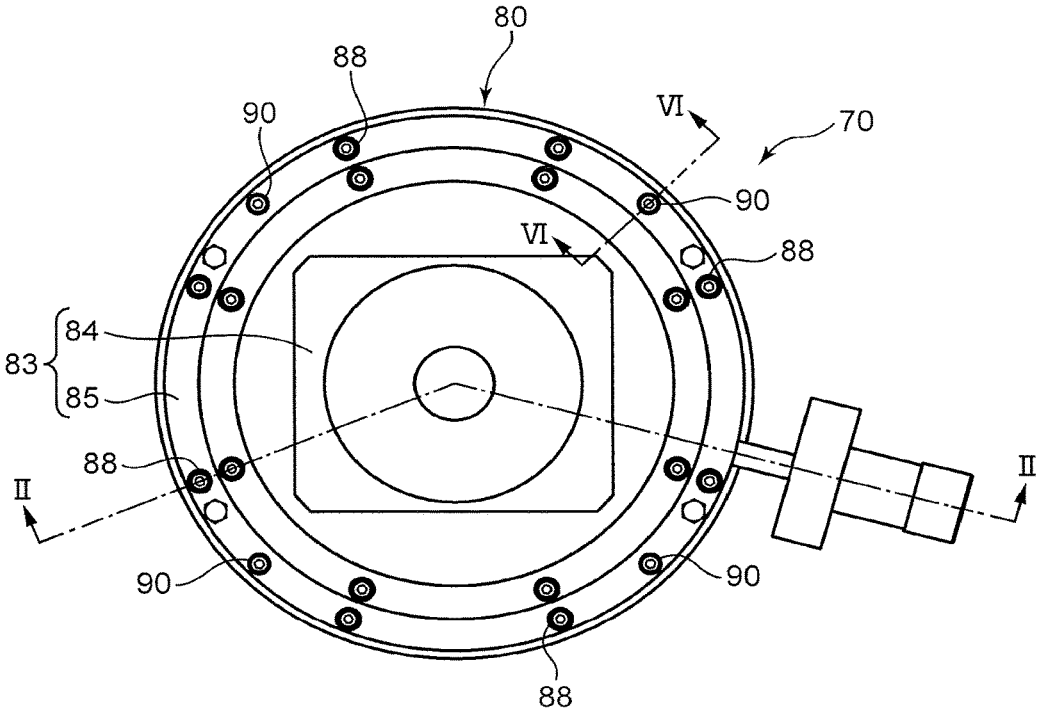
FIG. 5 is a plan view of the refrigeration unit.
Figure 6:
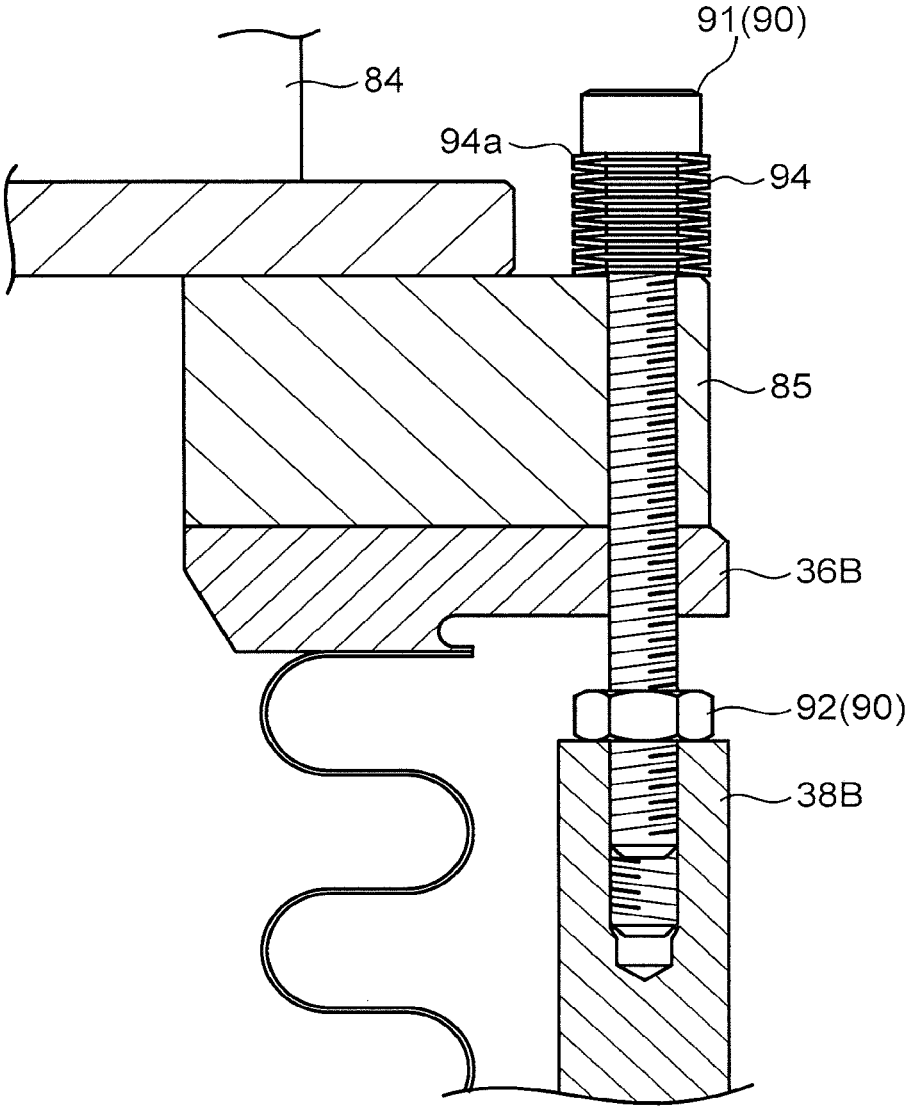
FIG. 6 is a sectional view taken along line VI-VI in FIG. 5.

The fixing members 88 fix the protruding portion 85 to a fixing portion 36B (see FIG. 2) provided above the second outer top wall 35B. As illustrated in FIG. 5, the plurality of fixing members 88 are arranged at an interval along the circumferential direction of the protruding portion 85. FIGS. 1, 2, and 4 are each a sectional view intersecting the fixing member 88 and the wiring hole 85*a*. FIG. 6 is an enlarged view of a cross section intersecting the fastening member 90.

As illustrated in FIGS. 2 and 6, the fastening members 90 fix the protruding portion 85 to a fixed table 38B provided on the second outer top wall 35B. The fastening force of each fastening member 90 can be adjusted. As illustrated in FIG. 5, a plurality of (four in the embodiment) fastening members 90 are arranged at a constant interval along the circumferential direction of the protruding portion 85. The fastening member 90 of the embodiment includes a bolt 91 and a nut 92. The shaft of the bolt 91 is long enough to penetrate the protruding portion 85 and the fixing portion 36B and to be screwed into the fixed table 38B. The nut 92 is screwed onto the shaft, being located at a portion above the fixed table 38B, of the bolt 91. Thus, the contact pressure of the first cooling stage 81 to the flange 25B gradually increases as the bolt 91 is further tightly fastened into the nut 92.

The stroke adjusting member 94 is disposed between the fastening member 90 and the refrigerator body 83. More specifically, as illustrated in FIG. 6, the stroke adjusting member 94 is provided between the head of the bolt 91 and the protruding portion 85. The stroke adjusting member 94 produces a fastening resistance against fastening of the fastening member 90 by contact with the bolt 91 of the fastening member 90. As the fastening force of the bolt 91 increases (as the bolt 91 is further tightly fastened) against the fastening resistance, the stroke adjusting member 94 elastically deforms by compression such that the distance between the head of the bolt 91 and the protruding portion 85 gradually decreases. The stroke adjusting member 94 includes a plurality of (13 in the embodiment) disk spring washers 94*a*.

A method for maintaining the refrigeration unit 70 will now be described. The method for maintaining the refrigeration unit 70 includes a removing step of removing the refrigeration unit 70, and a connecting step of reconnecting the refrigeration unit 70 after maintenance or replacement of the refrigeration unit 70.

In the removing step, whether the pressure in the helium tank 14 is positive is first determined. This is determined based on the value on the differential pressure gauge P. If the differential pressure gauge P indicates a negative value, helium gas is supplied into the helium tank 14 through the helium gas supply line 18B.

The refrigeration unit 70 is then removed with the pressure in the helium tank 14 kept positive. Specifically, the fixing members 88 and the fastening members 90 are removed and then the refrigeration unit 70 is pulled out of the second inner sleeve 15B and the second outer sleeve 16B along the direction indicated by the arrow in FIG. 1 (upward).

Since the heat conduction separative layer 97 is provided between the first cooling stage 81 and the flange 25B, the first cooling stage 81 can easily be separated from the flange 25B. Since the refrigeration unit 70 is removed with the pressure in the helium tank 14 kept positive, the air flow into the helium tank 14 during removal of the refrigeration unit 70 is minimized. This minimizes ice, having been formed by coagulation of the moisture in the air flown into the helium tank 14, depositing inside the helium tank 14 or a portion near the helium tank 14 (for example, the bottom portion of the second inner sleeve 15B).

The connecting step is performed after the removing step. That is, after maintenance or replacement of the refrigeration unit 70, the refrigeration unit 70 is mounted on the vacuum case 30 again. The connecting step is preferably performed as quickly as possible after the removing step to minimize the decrease in the volume of the liquid helium 12 in the helium tank 14. In the embodiment, the refrigeration unit 70 has an integrated structure including, for example, the second refrigerator 80 and the temperature sensor T1, so that the time which takes from the start of the removing step to the end of the connecting step is short.

Specifically, in the connecting step, the protruding portion 85 is fixed to the fixing portion 36B by the fixing members 88 with the first cooling stage 81 in a contact with the flange 25B via the heat conduction grease 95, the heat conduction sheet 96, and the heat conduction separative layer 97 (in thermal contact with the radiation shield 20).

The fastening force of the fastening member 90 is adjusted such that the temperature of the first cooling stage 81 becomes a target temperature. In the embodiment, the temperature of the first cooling stage 81 before maintenance, that is, before the removing step is used as the target temperature. The fastening force is adjusted as will be described below. The bolt 91 is fastened into the nut 92 with the stroke adjusting member 94 interposed between the head of the bolt 91 and the protruding portion 85 until the fastening resistance produced by the bolt 91 contacting the stroke adjusting member 94 reaches a predetermined value. At this point, the temperature of the first cooling stage 81, namely, a detected value of the temperature sensor T1 is checked. If the detected value is lower than the target temperature, it is considered that the first cooling stage 81 fails to sufficiently cool the radiation shield 20 (the first cooling stage 81 is excessively cooled) due to insufficient thermal contact (contact pressure) between the first cooling stage 81 and the radiation shield 20. If the temperature of the first cooling stage 81 is lower than the target temperature, the fastening force of the bolt 91 is increased (the bolt 91 is further tightly fastened). By increasing the fastening force, the stroke adjusting member 94 elastically deforms by compression such that the distance between the head of the bolt 91 and the protruding portion 85 decreases. The contact pressure of the first cooling stage 81 to the flange 25B thereby increases to create firmer thermal contact between the first cooling stage 81 and the radiation shield 20. The detected value of the temperature sensor T1 is then checked again. This procedure is repeated until the temperature of the first cooling stage 81 reaches the target temperature. When the detected value becomes the target temperature, the bolt 91 is no more fastened further tightly.

The refrigeration unit 70 is maintained as described above.

Note that, the presently disclosed embodiment is to be considered in all respects to be illustrative and not restricted. The scope of the present invention is described by the claims, not by the embodiment. Any modification made within the meaning and the scope of the doctrine of equivalents to the scope of the claims all falls within the scope of the present invention.

For example, in the connecting step, after attaching the fixing members 88, the fastening force of the bolt 91 may be adjusted (the bolt 91 may further tightly be fastened) such that the difference between the temperature of the cooling plate 24B (the detected value of the temperature sensor T2) and the temperature of the first cooling stage 81 (the detected value of the temperature sensor T1) becomes a predetermined value. In other words, the target temperature may be a temperature calculated by subtracting a predetermined value from the temperature of the cooling plate 24B (the temperature of the radiation shield 20). In such a case, whether preferable thermal contact between the first cooling stage 81 and the radiation shield 20 is created can be determined with higher accuracy than determining only by the temperature of the first cooling stage 81 as in the embodiment described above. Specifically, if the first cooling stage 81 is in sufficient thermal contact with the radiation shield 20, the temperature difference is very small. With this very small temperature difference set as the predetermined value, the thermal contact between the first cooling stage 81 and the radiation shield 20 can be determined with high accuracy. That is, if the temperature difference is larger than the predetermined value, the thermal contact between the first cooling stage 81 and the radiation shield 20 is considered insufficient. If the temperature difference is larger than the predetermined value, the bolt 91 is further tightly fastened until the temperature difference becomes the predetermined value.

The stroke adjusting member 94 is not necessarily the disk spring washer 94*a* but may be any member that is elastically deformable by compression by further tightly fastening the bolt 91. For example, a coil spring may be used as the stroke adjusting member 94.

The connection of the first cooling stage 81 is not necessarily at the flange 25B. The first cooling stage 81 may directly be connected to the radiation shield 20, that is, the second inner top wall 23B.

The liquid helium 12 and the helium tank 14 may be omitted. In such a case, the superconducting coil 10 is cooled by the refrigerators 60 and 80 via plates (for example, copper plates) joined to the second cooling stages 62 and 82 of the refrigerator 60 and 80.

The embodiment described above includes the following invention. A method for maintaining a refrigeration unit according to the embodiment is used for a superconducting magnet device including a superconducting coil, a radiation shield housing the superconducting coil, and a vacuum case housing the radiation shield, the refrigeration unit including a first cooling stage for cooing the radiation shield, a second cooling stage for cooling the superconducting coil, and a refrigerator body attachable to the vacuum case, the method including a connecting step of connecting the refrigerator body to the vacuum case with the first cooling stage in thermal contact with the radiation shield, wherein, in the connecting step, a fastening force of a fastening member is adjusted such that a temperature of the first cooling stage becomes a target temperature, the fastening member being for fixing the refrigerator body to the vacuum case and being configured to adjust, through adjustment of the fastening force of the fastening member, a contact pressure of the first cooling stage to the radiation shield or a heat conduction member in thermal contact with the radiation shield.

In the method for maintaining, in the connecting step, the fastening force of the fastening member is adjusted, while checking the temperature of the first cooling stage, such that the temperature of the first cooling stage becomes the target temperature (for example, the temperature of the first cooling stage before maintenance of the refrigeration unit). This minimizes chances of damage to the first cooling stage caused by a too large fastening force as well as insufficient thermal contact between the first cooling stage and the radiation shield caused by a too small fastening force. For example, if the temperature of the first cooling stage is lower than the target temperature, it is considered that the first cooling stage fails to sufficiently cool the radiation shield (the first cooling stage is excessively cooled) due to insufficient thermal contact (contact pressure) between the first cooling stage and the radiation shield or the heat conduction member. Accordingly, if the temperature of the first cooling stage is lower than the target temperature, the fastening force of the fastening member is increased.

In the method for maintaining a refrigeration unit, in the connecting step, a temperature calculated by subtracting a predetermined value from a temperature of the radiation shield is preferably used as the target temperature.

In such a case, whether preferable thermal contact between the first cooling stage and the radiation shield is created can be determined with higher accuracy than determining only by the temperature of the first cooling stage.

Specifically, if the first cooling stage is in sufficient thermal contact with the radiation shield, the difference between the temperature of the radiation shield and the temperature of the first cooling stage is very small. With this very small temperature difference set as the predetermined value, the thermal contact between the first cooling stage and the radiation shield can be determined with high accuracy. For example, if the temperature difference is larger than the predetermined value, that is, if the temperature of the first cooling stage is smaller than the temperature calculated by subtracting a predetermined value from the temperature of the radiation shield, the thermal contact between the first cooling stage and the radiation shield is estimated to be insufficient. In such a case, the fastening force of the fastening member is adjusted such that the temperature of the first cooling stage becomes a temperature calculated by subtracting the predetermined value from the temperature of the radiation shield.

In the method for maintaining a refrigeration unit, it is preferable that, in the connecting step, the refrigerator body is connected to the vacuum case with the first cooling stage in thermal contact with the radiation shield via a heat conduction sheet and a heat conduction separative layer layered on the heat conduction sheet, the heat conduction sheet being capable of filling a gap between the first cooling stage and the radiation shield or the heat conduction member.

In such a manner, preferable thermal contact is achieved between the first cooling stage and the radiation shield via the heat conduction sheet in the connecting step. Moreover, the interposed heat conduction separative layer allows the first cooling stage to easily separate from the radiation shield or the heat conduction member in the maintenance of the refrigeration unit.

Furthermore, it is preferable that the method for maintaining a refrigeration unit further includes a removing step of removing the refrigeration unit from the vacuum case before the connecting step, wherein the refrigeration unit is used for the superconducting magnet device further including a helium tank housing the superconducting coil and storing liquid helium in the radiation shield, and in the removing step, the refrigeration unit is removed with a pressure in the helium tank kept positive.

In such a manner, the air flow into the helium tank during removal of the refrigeration unit in the removing step can be minimized. This minimizes ice, having been formed by coagulation of the moisture in the air flown into the helium tank, depositing inside the helium tank or a portion near the helium tank.

Specifically, it is preferable that in the removing step, if the pressure in the helium tank is negative, helium gas is supplied into the helium tank until the pressure in the helium tank becomes positive and then the refrigeration unit is removed with the pressure in the helium tank kept positive.

A refrigeration unit according to the embodiment is used for a superconducting magnet device including a superconducting coil, a radiation shield housing the superconducting coil, and a vacuum case housing the radiation shield, the refrigeration unit including: a refrigerator including a first cooling stage for cooing the radiation shield, a second cooling stage for cooling the superconducting coil, and a refrigerator body attachable to the vacuum case with the first cooling stage in thermal contact with the radiation shield; a temperature sensor connected to the first cooling stage; a fastening member configured to detachably connect the refrigerator body to the vacuum case and to adjust, through adjustment of a fastening force of the fastening member, a contact pressure of the first cooling stage to the radiation shield or a heat conduction member in thermal contact with the radiation shield; and a stroke adjusting member that is provided between the fastening member and the vacuum case, configured to produce a fastening resistance against fastening of the fastening member by contact with the fastening member, and to elastically deform by compression such that a distance between the fastening member and the vacuum case gradually decreases as the fastening force of the fastening member increases against the fastening resistance.

In the refrigeration unit, the fastening members can be fastened further tightly (the fastening stroke can be adjusted), and the temperature of the first cooling stage can be adjusted by fastening the fastening members further tightly. By adjusting the fastening force of the fastening member such that the temperature of the first cooling stage becomes the target temperature (for example, the temperature of the first cooling stage before maintaining the refrigeration unit), the maintenance or replacement of the refrigeration unit can be completed with the first cooling stage in suitable thermal contact with the radiation shield. Specifically, the stroke adjusting member produces a fastening resistance by contact with the fastening member, so that a maintenance worker can stop fastening of the fastening member when feeling the fastening resistance (when a fastening torque has reached a predetermined value). Then, the worker checks the detected value of the temperature sensor (the temperature of the first cooling stage) at that point. If the temperature is lower than the target temperature, it is considered that the first cooling stage fails to sufficiently cool the radiation shield (the first cooling stage is excessively cooled) due to insufficient thermal contact (contact pressure) between the first cooling stage and the radiation shield. In this case, the fastening member is further tightly fastened (the fastening force of the fastening member is increased). As a result, the distance between the fastening member and the vacuum case decreases, and thus the contact pressure of the first cooling stage to the radiation shield or the heat conduction member increases. Thereby, the detected value increases and approaches the target temperature. With the adjustable first cooling stage temperature, chances of damage to the first cooling stage caused by a too large fastening force of the fastening member as well as insufficient thermal contact between the first cooling stage and the radiation shield caused by a too small fastening force can be minimized.

This application is based on Japanese Patent application No. 2016-068758 filed in Japan Patent Office on Mar. 30, 2016, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A method for maintaining a refrigeration unit used for a superconducting magnet device including a superconducting coil, a radiation shield housing the superconducting coil, and a vacuum case housing the radiation shield, the refrigeration unit including a first cooling stage for cooling the radiation shield, a second cooling stage for cooling the superconducting coil, and a refrigerator body attachable to the vacuum case, the method comprising:

a connecting step of connecting the refrigerator body to the vacuum case with the first cooling stage in thermal contact with the radiation shield, using a fastener fixing the refrigerator body to the vacuum case, the fastener being configured to be able to adjust, through adjustment of the fastening force of the fastener, a contact pressure of the first cooling stage to the radiation shield or a heat conductor in thermal contact with the radiation shield; and in the connecting step:

determining a target temperature for the first cooling stage, detecting a temperature of the first cooling stage, and adjusting a fastening force of the fastener such that the detected temperature of the first cooling stage in thermal contact with the radiation shield becomes the target temperature, and if the detected temperature of the first cooling stage is lower than the target temperature, the fastening force of the fastener is increased, wherein in the connecting step, the target temperature is a temperature calculated by subtracting a predetermined value from a temperature of the radiation shield.

2. The method for maintaining a refrigeration unit according to claim 1, wherein in the connecting step, connecting the refrigerator body to the vacuum case with the first cooling stage in thermal contact with the radiation shield via a heat conduction sheet and a heat conduction separative layer layered on the heat conduction sheet, the heat conduction sheet being capable of filling a gap between the first cooling stage and the radiation shield or the heat conductor.

3. The method for maintaining a refrigeration unit according to claim 1, further comprising a removing step of removing the refrigeration unit from the vacuum case before the connecting step, wherein the refrigeration unit is used for the superconducting magnet device further including a helium tank housing the superconducting coil and storing liquid helium in the radiation shield, and in the removing step, removing the refrigeration unit with a pressure in the helium tank kept positive.

4. The method for maintaining a refrigeration unit according to claim 3, wherein in the removing step, if the pressure in the helium tank is negative, supplying helium gas into the helium tank until the pressure in the helium tank becomes positive and then removing the refrigeration unit with the pressure in the helium tank kept positive.

5. The method for maintaining a refrigeration unit according to claim 1, further comprising a removing step of removing the refrigeration unit from the vacuum case before the connecting step, wherein the target temperature is the temperature of the first cooling stage before the removing step of removing the refrigeration unit from the vacuum case.

* * * * *